United States Patent [19]

Powell

[11] 4,418,871

[45] Dec. 6, 1983

[54] METHOD AND APPARATUS FOR REDUCING AND CLASSIFYING MINERAL CRYSTALLINE AND BRITTLE NONCRYSTALLINE MATERIAL

[75] Inventor: Stuart A. Powell, Englewood, Colo.

[73] Assignee: P.V. Machining, Inc., Santa Fe, N. Mex.

[21] Appl. No.: 283,746

[22] Filed: Jul. 15, 1981

[51] Int. Cl.[3] ..... B02C 23/08

[52] U.S. Cl. ..... 241/1; 241/24; 241/79.1; 241/301

[58] Field of Search ..... 241/1, 24, 27, 29, 79.1, 241/79.2, 79.3, 5, 39, 189 R, 152 A, 301, 14

[56] References Cited

U.S. PATENT DOCUMENTS

| | | | |
|---|---|---|---|
| 2,832,545 | 4/1958 | Segraves . | |
| 3,003,707 | 10/1961 | Lecher | 241/1 |
| 3,516,841 | 6/1970 | Haveman | 241/14 X |
| 3,680,796 | 8/1972 | Galeano | 241/79.1 X |
| 3,856,217 | 12/1974 | Brewer | 241/79.1 |
| 3,869,090 | 3/1975 | Roussel et al. | 241/5 |
| 3,973,733 | 8/1976 | Switzer | 241/1 |
| 4,077,574 | 3/1978 | Francis | 241/79.1 X |
| 4,098,464 | 7/1978 | Niedner et al. | 241/24 |
| 4,345,720 | 8/1982 | Takacs et al. | 241/79.3 X |

*Primary Examiner*—Mark Rosenbaum

*Attorney, Agent, or Firm*—Richards, Harris & Medlock

[57] ABSTRACT

A rapid reduction apparatus and method includes a reduction and classification apparatus (20) having a reducing unit (22) composed of a contraction cone (28) for receiving the material to be processed. The contraction cone (28) is connected to an expansion cone (32) through an intermediate venturi section (30). Air is drawn through the venturi section and the expansion cone (32) by a turbine (34) mounted below the expansion cone. A standing shock wave (310) is established in the expansion cone, and material loaded into the expansion cone is disintegrated and reduced as a result of attrition grinding within the shock wave and upon contact with the blades of the turbine. The reduced material is then discharged into the classifier assembly (50) where the particles and air flow undergo a series of vertical motion reversals defined by a plurality of baffles (112–128) extending alternately from the top and bottom of the classifier assembly (50). Each reverse in the air flow is accompanied with flow friction losses, thereby reducing wind velocity and applied particle pressure resulting in the discharge of particles of equivalent size and weight into corresponding hoppers (86–96) spaced along the flow path and substantially below each baffle extending from the top of the classifier assembly.

27 Claims, 6 Drawing Figures

METHOD AND APPARATUS FOR REDUCING AND CLASSIFYING MINERAL CRYSTALLINE AND BRITTLE NONCRYSTALLINE MATERIAL

TECHNICAL FIELD

The present invention is directed to a method and apparatus for size reduction, separation and classification of mineral crystalline and brittle noncrystalline substances. More particularly, the invention is to such a method and apparatus using air as the only fluid medium.

BACKGROUND ART

Systems presently used for the reduction, classification and concentration of crystalline mineral products require a plurality of steps and in many cases sophisticated and costly equipment. Normally, the present reducing and classifying apparatus incorporate a grinder or shredder which is initially used to reduce the size of the material to be classified. Thereafter, the material is carried by either a liquid or air medium and separated according to weight as the material is discharged or dropped from the flow stream. Lighter components are carried by the flow stream further than heavier particles and are discharged or dropped from the flow stream at a different location. Such a reduction and classification system is disclosed in U.S. Pat. No. 3,855,217, issued Dec. 24, 1974 to J. C. Brewer.

While such systems have met with some success, it will be appreciated that these units require elaborate grinding structures which initially reduce the size of the material to be classified. Moreover, classification of the units is inexact in that the materials are not clearly separated by the process. On occasion, heavier components will be carried with the flow stream to more remote discharge positions, while lighter materials may fall from the flow stream at an early point in the process and be improperly classified with the heavier or larger particles of material.

In view of the significant equipment necessary for the reduction and classification process such as that shown in the Brewer patent, these systems are not normally portable but must be assembled and operated in one location. Thus, these systems do not reduce the expense and time involved in transporting the materials to be reduced and classified to the site of the reduction and classification units. Often, the expense of transporting such materials to the treatment facility represents a sizable portion of the cost involved in the reducing and classification process.

In other systems, where a shredder or reducing mechanism is not used, the use of an air classification system is rendered almost unusable in that classification of material having naturally large or heavy components cannot be carried to any significant degree by an air flow system. In these systems, other mediums such as fluids are required, thereby adding to the complexity and expense not associated with air classification systems using an air medium only.

Classification of crystalline mineral products has normally required the use of certain chemical treatments in the final concentration process. Where such chemical treatment is required, the potential for environmental contamination is introduced. Additionally, an added cost, both by way of the cost of chemicals involved and additional equipment required to handle such chemicals, is introduced by such systems.

Thus, the need has arisen for a relatively low cost reduction and classification system which is capable of high volume production, as well as applicable to reduction and classification of a wide range of minerals and brittle noncrystalline materials. Moreover, the need has arisen for such a system which is portable and one that eliminates potential environmental hazards normally introduced by the requirement of chemical treatment in any phase of the process.

SUMMARY OF THE INVENTION

The present invention provides a reduction and classification system for use with crystalline material and brittle noncrystalline material. The process may be adapted for use in recovery of metallic minerals from ores, cleaning and classifying crystalline hydrocarbons, and cleaning and classifying brittle noncrystalline materials. The present invention provides a system which is very simple in fabrication and requires minimal maintenance. The energy consumption of the apparatus is small in comparison with current systems of equivalent capacity. As a result, the present system provides for reduction and classification at a relatively low cost, while being capable of being broken down and moved as necessary to reduce or eliminate a large portion of transportation expense in bringing materials to the unit for reduction and classification.

The present system uses air as the fluid medium and eliminates any need for chemical treatment in the final concentration process. Thus, the system eliminates the risk of environmental contamination associated with chemical treatment. As will be appreciated in view of the full disclosure of the invention, the present system provides the capability for high volume production of material, while being capable of accommodating a wide range of crystalline minerals and noncrystalline materials.

In accordance with a broad aspect of the invention, raw material is fed to the first stage of the system and is reduced to a predetermined size. The reduced material is then exhausted into the second stage of the system where it is classified by both specific gravity and particle size. Concentration of desirable components is a naturally occurring result of the classification process.

In a preferred embodiment of the invention, the raw material is reduced in a milling apparatus having a hopper or contraction cone leading to an expansion cone through an intermediate venturi section. The milling apparatus further includes a turbine having a housing with an inlet for receiving material discharged from the expansion cone and an outlet for discharging said material to a classifier unit. A turbine rotor is rotatably mounted in the turbine housing. Upon rotation of the turbine rotor, a standing shock wave is set up in the venturi section of the expansion cone. Material discharged into the hopper encounters the shock wave resulting in disintegration of the material. The material is further reduced in size as a result of an attrition grinding within the shock wave and engagement of the material on the blades of the turbine rotor.

The reduced material is thereafter passed from the reduction device to a classifier unit. As a result of the use of baffles positioned in the classifier unit, the reduced particles are carried by the air stream generated by the turbine along a path defined in the classifier unit which includes a series of vertical motion reverses. As the particles move along this path, they are subjected to both the influence of gravity and air pressure which imparts a momentum to each particle. As the air stream reverses direction from a downward to an upward movement, the gravity influence acts with a countereffect to the effect applied by the air pressure force. Each reverse in the air flow is accompanied with flow friction losses, thereby reducing wind velocity and applied particle pressure in each subsequent vertical turn. As a result, each subsequent vertical rising movement will sustain only certain size and weight equivalent particles. At each vertical turn, particles having a particular size and weight will fall from the air flow stream and be classified and therefore concentrated with particles of similar size and weight. Hoppers are positioned appropriately along the air flow stream to collect the particles discharged from the flow path.

In a preferred embodiment of the invention, the classifier unit includes a plurality of baffles extending from the top of said unit and a plurality of baffles extending from the bottom of said unit. The baffles extending from the bottom of the unit are positioned intermediate of the baffles extending from the top. In this way, air must flow in a downward direction to bypass baffles extending from the top of the unit only to confront an upwardly extending baffle from the bottom of the unit which causes the air to flow upwardly. The air flow confronts a successive pair of downwardly and upwardly extending baffles causing a plurality of vertical reversals in the air flow stream. Hoppers are positioned substantially below each baffle extending from the top of the collector and receive material dropped from the flow as the flow changes direction from a downward to an upward motion.

In accordance with another embodiment of the invention, a filter screen is positioned within the classifier unit in the air flow path upstream of the first baffle extending downwardly from the classifier unit top. This screen restricts the movement of particles greater than the size of the mesh therein from passing therebeyond. A hopper is positioned upstream of the screen and opens into the classifier unit for receiving material restricted from movement beyond the screen.

In accordance with a more specific embodiment of the invention, each baffle extending upwardly from the bottom of the classifier unit is positioned intermediate of each hopper, thereby directing the material which falls from the air flow upstream of the upwardly extending baffle into the hopper positioned upstream of the baffle. Moreover, the baffles extending downwardly within the classifier unit extend to a point closer to the bottom of the classifier unit than the uppermost point of the baffles extending from the bottom of the classifier unit. In this way, air flowing through the classifier unit is forced to undergo a plurality of vertical reverses as it passes through the unit.

An exhaust duct communicates with the classifier unit at a point remote from the point of introduction of material into the unit for exhausting air and particles not dropped from the flow as it passes through the unit.

The turbine used in the present invention includes a turbine rotor having a rotatable shaft with a plurality of turbine blades extending therefrom. The turbine blades include an upper and lower edge with the upper edge inclined forward of the lower edge by a predetermined angle. In the preferred embodiment of the invention, this angle is approximately 3°. The blades of the turbine include a planar surface having a concave portion intermediate of the upper and lower edges and extending from a point outboard from the shaft to the outer edge of each blade. The blades have a protective insert on the upper edge thereof. Material discharged from the expansion cone is fed into the turbine substantially along the axis of rotation of the turbine rotor. These materials are engaged by the turbine blades and are discharged in a plane substantially perpendicular to the axis of rotation.

As can be appreciated, the only movable parts in the system are the turbine rotor, the rotor shaft and the required drive motor for driving the turbine rotor. Thus, the system provides a method for reducing and classifying materials using air as the only fluid medium and requiring a minimum of movable parts, as well as other structure to accomplish the reduction and classification process.

BRIEF DESCRIPTION OF THE DRAWINGS

For a more complete understanding of the present invention, and for further details and advantages thereof, reference is now made to the following description taken in conjunction with the accompanying drawings, in which.

DETAILED DESCRIPTION

Figure 1:
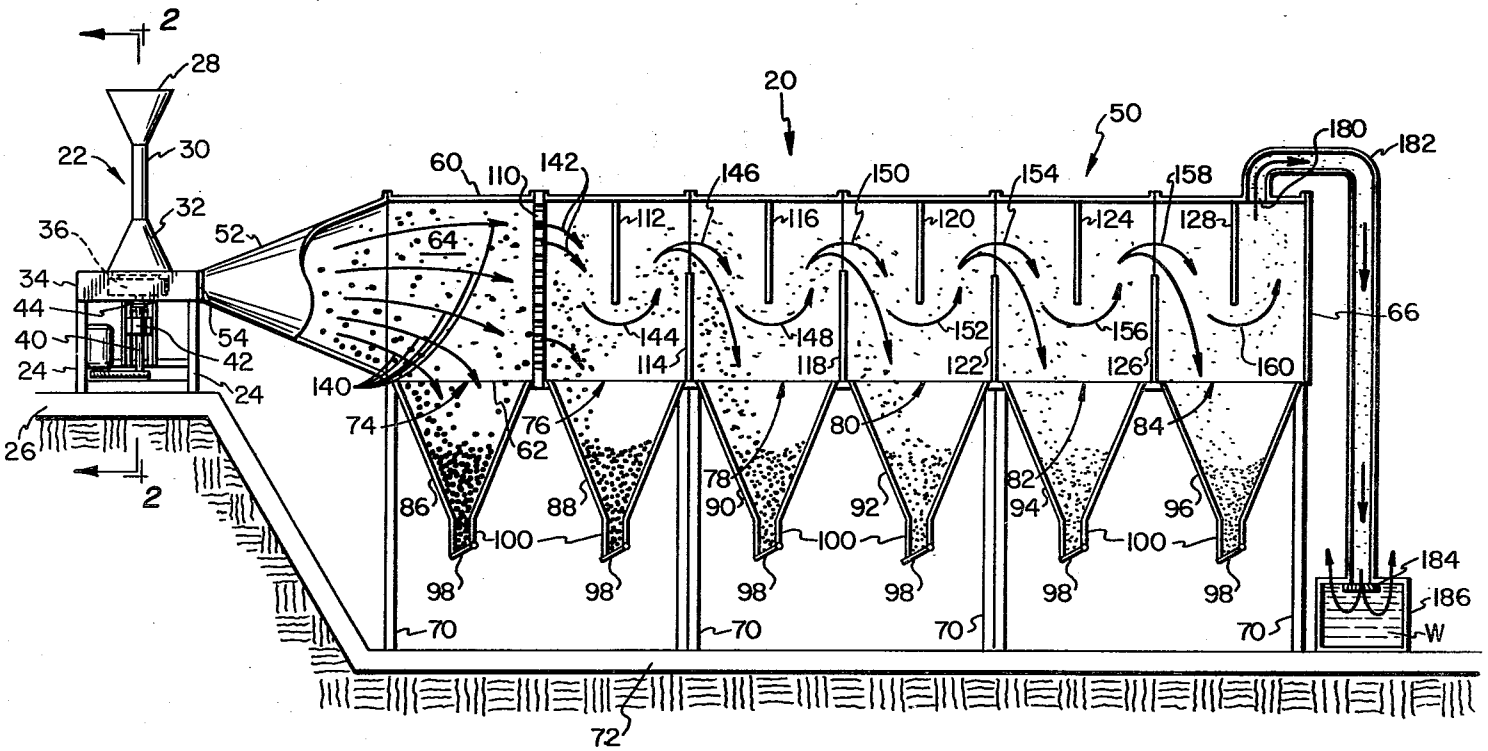
FIG. 1 is a partially broken away side plane view of the rapid reduction classifier according to the present invention.

Referring to FIG. 1, the reduction and classification apparatus 20 according to the present invention includes a reducing unit 22 supported on frame members 24 from an appropriate foundation 26. Reducing unit 22 includes a contraction cone 28 for receiving the material to be processed. Contraction cone 28 has a converging conical shell which is connected to a cylindrical venturi section 30. Venturi section 30 is in communication with the upper end of an expansion cone 32. Material fed into contraction cone 28 is directed through venturi section 30 and expansion cone 32 into a turbine housing 34 which houses a turbine wheel 36 mounted for rotation on a turbine rotor shaft 40 supported by a thrust bearing 42 and an upper guide bearing assembly 44.

Reducing unit 22 is connected at turbine housing 34 to classifier assembly 50 by an entry duct 52. Entry duct 52 is a diverging section having its smaller end connected by an appropriate connecting flange and gasket to the discharge opening 54 of turbine housing 34. The opposite end of entry duct 52 is connected by appropriate flanges to the inlet of classifier assembly 50. Classifier assembly 50 consists of a top and bottom 60 and 62, respectively, and side walls 64 joined between top 60 and bottom 62 to form a rectangular elongated chamber. Classifier assembly 50 includes a back wall 66. Classifier assembly 50 is supported by support legs 70 mounted to bottom 62 of the classifier assembly and provides support for the classifier assembly 50 from an appropriate foundation 72 as shown.

Bottom 62 of classifier assembly 50 has a plurality of spaced openings 74, 76, 78, 80, 82 and 84. Hopper sections 86, 88, 90, 92, 94 and 96 are mounted to bottom 62 of classifier assembly 50 at openings 74, 76, 78, 80, 82 and 84, respectively, for the receipt of material directed through the openings. A hopper section gate 98 is pivotally mounted on the lower funnel opening 100 of each of hoppers 86, 88, 90, 92, 94 and 96. As can be seen in FIG. 1, the openings 74, 76, 78, 80, 82 and 84 in the bottom 62 of classifier assembly 50 are substantially equal in length and result in an equal spacing of hoppers 86 through 90 along the length of classifier assembly 50.

A screen 110 is vertically mounted within classifier assembly 50 between top 60, bottom 62 and side wall 64 and intermediate of hopper sections 86 and 88. A plurality of baffles 112, 114, 116, 118, 120, 122, 124, 126 and 128 are vertically mounted from top 60 and bottom 62 and between side wall 64 within classifier assembly 50. Baffle 112 is mounted from top 60 substantially over the center of hopper section 88. Baffle 114 extends upwardly from bottom 62 intermediate of hopper sections 88 and 90. Air baffle 116 extends downwardly from top 60 and between side wall 64 substantially over the center of hopper section 90. Air baffle 118 extends upwardly from bottom 62 and between side wall 64 intermediate of hopper sections 90 and 92. Air baffle 120 extends downwardly from top 60 and between side wall 64 substantially over hopper section 92. Air baffle 122 extends upwardly from bottom 62 and between side wall 64 intermediate of hopper sections 92 and 94. Air baffle 124 extends downwardly from top 60 and between side wall 64 substantially over the midpoint of hopper section 94. Air baffle 126 extends upwardly from bottom 62 and between side wall 64 intermediate of hopper sections 94 and 96. Air baffle 128 extends downwardly from top 60 and between side wall 64 substantially over the center of hopper section 96.

As can be seen in FIG. 1, baffles 112 through 128 are substantially equal in height and are greater than half the height of classifier assembly 50. In this way, baffles 112, 116, 120, 124 and 128 extend downwardly more than half the height of classifier assembly 50. Similarly, baffles 114, 118, 122 and 126 extend upwardly from bottom 62 substantially above the midpoint of the height of classifier assembly 50. As a result, the projection of the baffles extending downwardly from top 60 and the projection of the baffles extending upwardly from bottom 62 is on a vertical plane overlap. This arrangement results in the movement of the air directed into classifier assembly 50 through a path including a plurality of vertical motion reverses.

Referring still to FIG. 1, air, and material injected within classifier assembly 50 from turbine housing 34, enters through entry duct 52 along the path identified by arrows 140. Particles screened by screen 110 fall to the bottom of classifier assembly 50 and are collected in hopper 86. The air and particles which are not screened therefrom by movement of the flow through screen 110 continue along the path identified by arrows 142. As a result of the position of baffle 112, air, and material flowing therewith, move downwardly below baffle 112 and thereafter turn upwardly as identified by the path defined by arrow 144. As a result of this first vertical reverse, the influences of gravity act with a countereffect to the momentum applied to the air and particles contained therein by air pressure forces. Certain particles of sufficient weight or size are dropped from the air flow and are collected in hopper 88. Those particles not dropped from the air stream move upwardly over baffle 114 and then downwardly as identified by the path defined by arrow 146. Again, the direction of the air flow is directed downwardly as a result of air baffle 116 and as the air confronts upwardly extending air baffle 118, the air and certain of the materials contained therein undergo a vertical motion reverse identified by the path illustrated by arrow 148. As a result of this vertical reverse, certain particles are dropped from the air stream and are collected in hopper 90. It will be appreciated that each reverse in the air flow is accompanied with flow friction losses, thereby reducing wind velocity and applied particle pressure with each turn. As a result, each subsequent vertical rising movement will sustain only certain size and weight equivalent particles. Thus, at each vertical turn, particles having a particular size and weight will fall from the air flow stream and be classified and therefore concentrated with particles of similar size and weight.

As will now be appreciated, the air flow through the classifier assembly follows the path indicated by arrows identified by the numerals 150, 152, 154, 156, 158 and 160. These paths are defined as a result of the positioning of the baffles 118, 122 and 126 extending upwardly from the bottom of the classifier assembly and baffles 120, 124 and 128 extending from the top of the classifier assembly and positioned intermediate of the upwardly extending baffles. With each vertical reverse as identified by the path defined by arrows 152, 156 and 160, particles having a particular size and weight will fall from the air flow stream and be classified, respectively, in hoppers 92, 94 and 96. Specifically, the particles collected in hoppers 88, 90, 92, 94 and 96 are classified in groups having particles of progressively smaller sizes.

Each hopper section gate 98 is counterbalanced such that upon accumulation of material in the appropriate hopper section greater than the counterweight, the accumulated material is discharged for collection. Although not shown, collection may be by way of tank car or truck positioned below each hopper section.

An exhaust port 180 is formed in the top 60 of classifier assembly 50 downstream of air baffle 128. An exhaust duct 182 at port 180 is connected to top 60 and receives the terminus of air flow flowing through classifier assembly 50. The lower end of exhaust duct 182 is connected to an exhause diffuser screen 184 resting in an exhaust cleaner tank 186 which is filled with water W.

Figure 2:
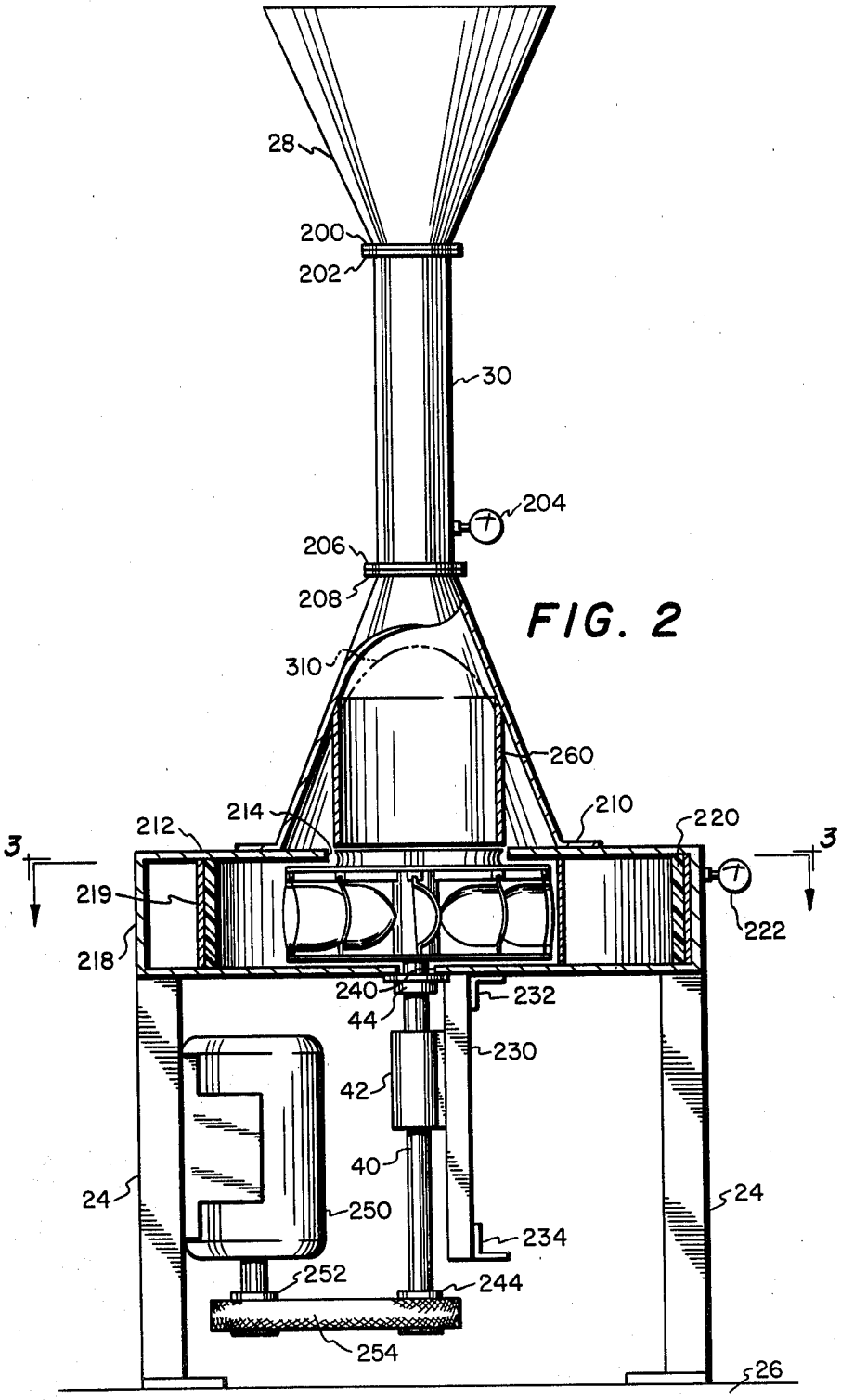
FIG. 2 is a partially broken away side plane view of the milling apparatus used in the present invention.
Figure 3:
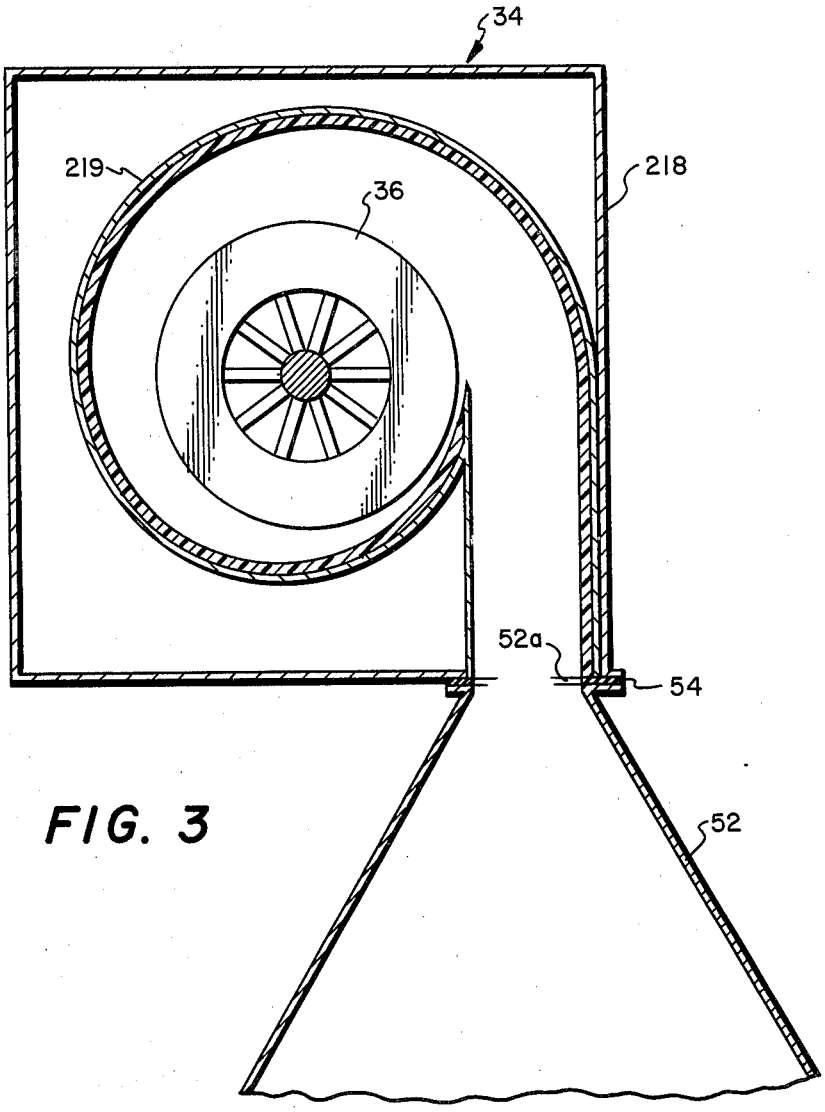
FIG. 3 is a section view taken along lines 3—3 of FIG. 2.

FIGS. 2–6 disclose the reducing unit in greater detail. Referring to FIGS. 2 and 3, it can be seen that contraction cone 28 is connected at its lower end by flange 200 to a flange 202 attached to the upper end of venturi section 30. An appropriate gasket, such as one made of neoprene, is positioned between these flanges to provide an airtight seal. A pressure gauge 204 is mounted near the lower end of venturi section 30. The lower end of section 30 is attached by a flange 206 mounted on the lower end to the upper end of expansion cone 32 at flange 208. The lower end of expansion cone 32 has an outturned flange 210 which is attached to turbine housing 34. Each is attached with an appropriate gasket to provide an airtight seal. Housing 34 has an upper wall 212 having a circular aperture 214 formed therein, a lower wall 216 parallel to upper wall 212 and an outer wall 218. As is seen in FIG. 3, an increasing diameter vertical spiral wall 219 is mounted between upper wall 212 and lower wall 216. An abrasion liner 220 is positioned on the interior of spiral wall 219. Referring still to FIG. 3, wall 219 has an increasing spiral diameter leading to a discharge chute aligned to direct material to the mouth 52*a* of entry duct 52. As will be described in greater detail hereinafter, material fed to turbine wheel 36 is propelled radially outwardly from the turbine shaft and directed in a cyclone type fashion out of turbine housing 34 and into entry duct 52 at its mouth 52*a*.

Referring again to FIG. 2, turbine wheel 36 is mounted for rotation on a turbine rotor shaft 40 supported by thrust bearings 42. Thrust bearings 42 are supported by bearing mount channels 230 fixed in position by a pair of bearing mount channel cross angle supports 232 and 234. Angle 232 is attached from bottom wall 216 of the turbine housing and angle 234 is supported by a cross brace (not shown) attached between frame members 24. As has been previously described, turbine housing 34 is supported from an appropriate foundation 26 by frame members 24. Turbine rotor shaft 40 is also supported by an upper guide bearing assembly 44 which is attached to bottom wall 216 of the turbine housing. Turbine rotor shaft 40 passes through lower wall 216 at an aperture 240 therein and receives a plurality of turbine blades 242 attached thereto and extending substantially radially outwardly from the shaft.

A turbine wheel shaft sheave 244 is attached to the lower end of shaft 40 and is driven by motor 250 by way of motor sheave 252 and drive belt 254. Motor 250 is attached and supported by frame member 24. In the preferred embodiment, motor 250 is a 25 horsepower motor geared to drive turbine wheel 36 at from 3200 to 3500 rpm.

Figure 4:
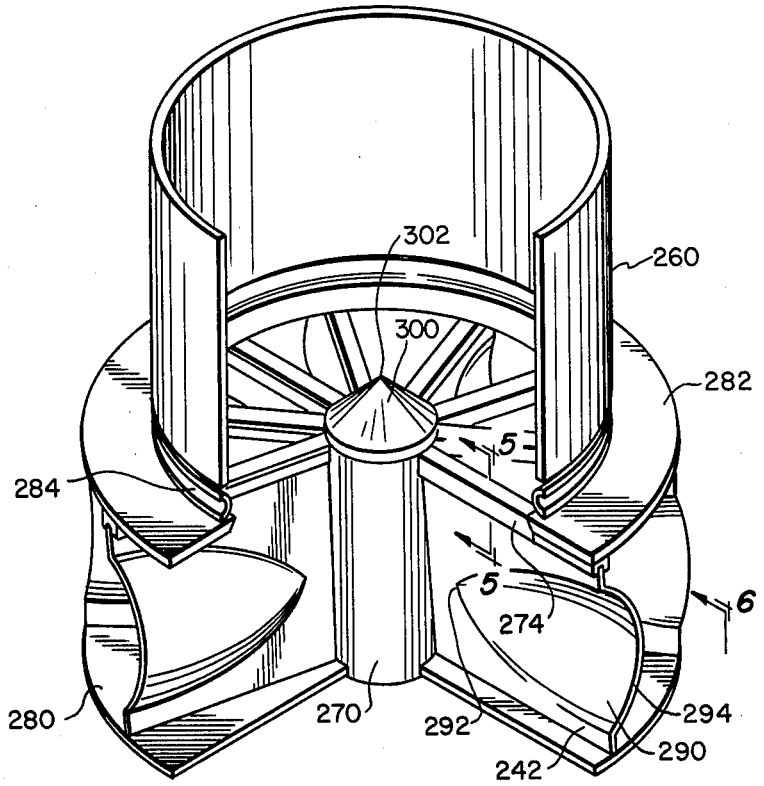
FIG. 4 is a partially broken away perspective view of the turbine used in the present invention.
Figure 5:
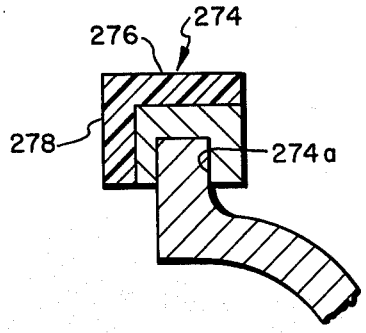
FIG. 5 is a section view taken along lines 5—5 of FIG. 3.

Referring to FIGS. 2 and 4, an inner wind shroud 260 is attached, such as by welding, to the inside of expansion cone 32. Wind shrouds 260 are cylindrical in shape having a constant diameter and extending downwardly substantially aligned over turbine wheel 36. Referring specifically to FIG. 4, turbine wheel 36 further includes a hub 270 which is received over the upper end of and attached to turbine rotor shaft 40. Blades 242 extend substantially radially outwardly therefrom. Protector inserts 274 are mounted to the upper edges of blades 262 as shown in detail in FIG. 5. Inserts 274 have a groove 274*a* cut therein to receive the upper edge of blades 242. The outwardly facing surfaces 276 and 278 (FIG. 5) are ranite hardened to resist wear and abrasion. A turbine backing plate 280 extends radially from turbine hub 270 and the lower edge of blades 242 are attached thereto. A turbine wheel upper stabilizer ring 282 is attached to the upper edge of blades 242 by attachment to protector inserts 274. Ring 282 has an outer diameter substantially equal to the outer diameter of backing plate 280 and an inside diameter substantially equal to the diameter of inner wind shroud 260. A turbine venturi ring 284 is attached to the upper surface of ring 282 at its inside edge. Turbine venturi ring 284 has an inside diameter substantially equal to the inside diameter of wind shroud 260. As can be seen in FIG. 2, turbine wheel 36 is positioned such that the upper edge of turbine venturi ring 284 is positioned adjacent to but slightly below the bottommost edge of wind shroud 260. Further, the inside diameter of wind shroud 260 is substantially aligned with the inside diameter of turbine venturi ring 284.

Figure 6:
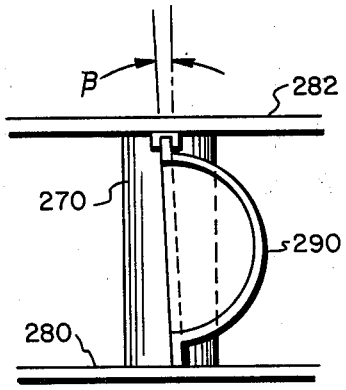
FIG. 6 is a view of the turbine of the present invention as seen from along lines 6—6 of FIG. 4.

Referring again to FIGS. 4, 5 and 6, blades 242 have a concave intermediate portion 290 which extends from a point 292 spaced radially outwardly from hub 270 and intermediate of the upper and lower edges of the blade increasing in width to the outer edge 294 of blade 242. Referring to FIG. 6, blades 242 are canted such that the upper edge is slightly leading the bottommost edge by an angle $\beta$. In a preferred embodiment of the invention, this angle is on the order of 3°.

A turbine wheel bullnose cap 300 is attached to the upper end of hub 270. Cap 300 has a conical upper surface having its apex 302 at the centermost point of the cap.

In operation of the present invention, material is fed into contraction cone 28 of the milling device and passes through the venturi section 30. As the material moves into the expansion cone 32, it encounters the static shock wave 310 generated therein. This static shock wave is generated as a result of the rotation of turbine wheel 36 which draws in air through the venturi section 30 and into expansion cone 32, discharging the air into the classifier assembly 50. In the preferred embodiment of the invention, turbine wheel 36 is rotated at a constant speed of from between 3200 and 3600 rpm, the turbine wheel being driven by a 25 horsepower motor 250. The increase in air volume and speed through the venturi section to near the speed of sound and the subsequent expansion in the expansion cone causes supersonic flow at or about the point indicated by the line 310 wherein the standing shock wave is generated.

Material disintegration occurs as the material enters the shock wave with further reduction and size occurring as a result of attrition grinding within the shock wave and upon contact with the turbine wheel blades. The reduced material then passes from the reduction device into the classifier assembly 50. The milled particles are carried by the air stream along the path identified by arrows 140. Particles having a size greater than the mesh in screen 110 are blocked from further movement through the classifier assembly and fall out of the air stream and are collected in hopper 86. The remaining particles and air flow continue along the path identified by arrows 142 and follow a series of vertical motion reverses identified by arrows 144, 146, 148, 150, 152, 154, 156, 158 and 160 as a result of the positioning of baffles 112 through 128. As the air flow and particles move downwardly, the particles fall under the combined influence of gravity and air pressure which imparts a momentum to the particles. The air stream is then reversed to an upward motion, at which time the gravity influence acts with a countereffect to the applied air pressure force. Each reverse in the air flow is accompanied with flow friction losses, thus reducing wind velocity and applied particle pressure in each subsequent vertical turn. Thus, each subsequent vertical rising movement will sustain only certain size and weight equivalent particles. The balance of the air stream particle load falls into the respective hopper positioned therebelow.

The net concentration effect is obtained when certain material particles are reduced to predominantly one size, thereby concentrating the particles in a particular collecting hopper. Air from the unit is exhausted through exhaust duct 182 which is connected to an exhaust cleaner tank 186.

It will now be appreciated that the present invention provides a very effective reduction and classifier unit which provides for very low cost classification without the need for any chemical treatment in the process. Thus, potential environmental hazards are eliminated. The system and process may be used in recovery of metallic minerals from ores, cleaning and classifying crystalline hydrocarbons or cleaning and classifying brittle noncrystalline materials. The invention is portable and provides for the high volume production necessary in the reduction and classification process of various materials. Moreover, the present invention provides these features with a system having a minimum of moving parts.

Although preferred embodiments of the invention have been described in the foregoing detailed description and illustrated in the accompanying drawings, it will be understood that the invention is not limited to the embodiments disclosed but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

I claim:

1. A method of classifying crystalline material comprising:

reducing said crystalline material to a predetermined size by using a centrifugal type turbine to draw said material through an expansion cone such that a standing shock wave is set up in the expansion cone resulting in attrition grinding of the material, directing said reduced material along a course through a classifier unit having a plurality of baffles extending alternately from the bottom and from the top of said unit into the body of the unit, thereby defining a plurality of vertical motion reverses through the unit, and collecting the material which falls from the course at each vertical reverse, thereby classifying said material.

2. The method according to claim 1 further comprising:

further reducing said material by engagement of said material by the blades of said turbine.

3. The method according to claim 1 further comprising:

filtering said material to remove particles having a size greater than the filter mesh prior to directing said material through the vertical reverses, and collecting said material filter as a result of said filtration step.

4. An apparatus for classifying material comprising:

means for reducing said material to predetermined sizes comprising a milling apparatus having an expansion cone with an inlet for receiving material therein and an outlet for discharging said material therefrom, a turbine having a housing with an inlet for receiving material discharged from the outlet of said expansion cone and an outlet for discharging said material, and a turbine rotor rotatably mounted in said turbine housing, and means for rotating said turbine rotor to draw air into and through said expansion cone whereby a standing shock wave is set up within the expansion cone causing attrition grinding of said material, stationary means for directing said reduced material along a course having a plurality of vertical motion reverses, and means positioned along said course for collecting material falling from said course thereby classifying said material.

5. The apparatus according to claim 4 wherein said collecting means includes separate collecting structure positioned below each point where said material movement changes from a downward to an upward direction.

6. The apparatus according to claim 4 wherein said material is drawn through said turbine after passing through the expansion cone and wherein engagement of said material by said turbine further reduces said material.

7. The apparatus according to claim 4 wherein said material is discharged from the expansion cone to the turbine substantially along the axis of rotation of said turbine rotor and is discharged in a plane substantially perpendicular to the axis of rotation.

8. The apparatus according to claim 4 wherein said directing means includes a classifier unit for receiving material discharged from the turbine, said unit having a plurality of baffles extending from the top of said unit and a plurality of baffles extending from the bottom of said unit, said baffles extending from the bottom of said unit being positioned intermediate of the baffles extending from the top thereof, and hoppers positioned substantially below each baffle extending from the top of said collector for receiving material dropped from said flow as said flow changes direction within said unit.

9. The apparatus according to claim 8 further comprising:

a filter screen positioned within said unit in said course and upstream of said first baffle extending downwardly from said unit top, said screen restricting the movement of particles greater than the site of said screen mesh from passing therebeyond, and a hopper positioned upstream of said screen and opening into said unit for receiving the material restricted from movement beyond said screen.

10. The apparatus according to claim 8 wherein said baffles extending upwardly from the bottom of said unit are positioned intermediate of each said hopper.

11. The apparatus according to claim 8 wherein said downwardly extending baffles extend downwardly within said unit to a point closer to the bottom of said unit than the uppermost point of the baffles extending from the bottom of said unit.

12. The apparatus according to claim 8 further comprising:

an exhaust duct communicating with said unit at a point remote from the point of introduction of material into said unit for exhausting air flow and particles not dropped from the flow through said unit.

13. The apparatus according to claim 4 wherein said turbine includes a turbine rotor having a rotatable shaft with a plurality of turbine blades extending therefrom, said turbine blades including an upper and lower edge with the upper edge positioned forward of the lower edge by a predetermined angle.

14. The apparatus according to claim 13 wherein said predetermined angle is approximately 3°.

15. The apparatus according to claim 13 wherein the blades of said turbine rotor further include a planar surface having a concave portion intermediate of the upper and lower edges and extending from a point outboard from the shaft to the outermost edge of each blade.

16. The apparatus according to claim 13 wherein the blades of said turbine rotor have a protector insert on the upper edge thereof.

17. An apparatus for reducing and classifying material comprising:

a reduction apparatus including an expansion cone and a turbine having a turbine rotor and turbine housing, said expansion cone having an inlet for receiving material therein and an outlet for discharging said material to the inlet of the turbine housing, said turbine housing having an outlet for discharging material therefrom, means for rotating said turbine rotor for setting up a standing shock wave in the expansion cone to reduce material directed through the expansion cone and for discharging said material from the turbine housing outlet, a classifier unit for receiving material discharged from said turbine housing, said classifier unit including a plurality of baffles extending alternately from the bottom and from the top of said unit into the body of said unit, thereby defining a plurality of reverse vertical direction paths through said unit, and hopper means positioned substantially below each baffle extending from the top of said unit for collecting material dropped from said flow as it passes through said unit.

18. The apparatus according to claim 17 wherein said material is drawn through said turbine after passing through the expansion cone and wherein engagment of said material by said turbine further reduces said material.

19. The apparatus according to claim 17 further comprising:

a filter screen positioned within said classifier unit and upstream of said first baffle extending downwardly from said unit top, said screen restricting the movement of particles greater than the size of said screen mesh from passing therebeyond, and a hopper positioned upstream of said screen and opening into said unit for receiving the material restricted from movement beyond said screen.

20. The apparatus according to claim 17 wherein said baffles extending upwardly from the bottom of said unit are positioned intermediate of each said hopper.

21. The apparatus according to claim 17 wherein said downwardly extending baffles extend downwardly within said unit to a point closer to the bottom of said unit than the uppermost point of the baffles extending from the bottom of said unit.

22. The apparatus according to claim 17 further comprising:

an exhaust duct communicating with said unit at a point remote from the point of introduction of material into said unit for withdrawing air flow and particles not dropped from the flow through said unit.

23. The apparatus of claim 17 wherein said material is discharged from the expansion cone to the turbine rotor substantially along the axis of rotation of said motor and is discharged in a plane substantially perpendicular to the axis of rotation.

24. The apparatus according to claim 17 wherein said turbine blades include an upper and lower edge with the upper edge inclined forward of the lower edge by a predetermined angle.

25. The apparatus according to claim 24 wherein said predetermined angle is approximately 3°.

26. The apparatus according to claim 24 wherein said turbine blades further include a planar surface having a concave portion intermediate of the upper and lower edges and extending from a point outboard from the shaft to the outermost edge of the blades.

27. The apparatus according to claim 24 wherein each said turbine blade has a protector insert on the upper edge thereof.

* * * * *